US007066647B2

(12) United States Patent
Peska

(10) Patent No.: US 7,066,647 B2
(45) **Date of Patent: *Jun. 27, 2006**

(54) COLLAPSIBLE CONTAINERS

(75) Inventor: Lawrence Peska, Garnerville, NY (US)

(73) Assignee: Bajer Design & Marketing, Inc., Waukesha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/422,393

(22) Filed: Apr. 24, 2003

(65) Prior Publication Data

US 2003/0194152 A1 Oct. 16, 2003

Related U.S. Application Data

(63) Continuation-in-part of application No. 10/043,931, filed on Jan. 11, 2002, now Pat. No. 6,585,414.

(60) Provisional application No. 60/261,079, filed on Jan. 11, 2001.

(51) Int. Cl.
*B65D 30/22* (2006.01)

(52) U.S. Cl. ..... 383/40; 383/41; 383/66; 383/28; 383/14; 383/16; 220/9.2; 190/107

(58) Field of Classification Search ..... 220/530, 220/531, 9.2, 754; 135/126; 383/40, 41, 383/164, 117, 66, 97, 121, 28, 26, 25, 21, 383/12, 14, 16, 119; 190/107, 121, 119
See application file for complete search history.

(56) References Cited

U.S. PATENT DOCUMENTS

| | | | | |
|---|---|---|---|---|
| 216,227 | A * | 6/1879 | Sedgwick | 220/9.2 |
| 1,832,715 | A * | 11/1931 | London | 206/287 |
| 2,016,520 | A * | 10/1935 | Short | 206/289 |
| 2,517,757 | A * | 8/1950 | Adlerstein | 312/3 |
| 2,761,480 | A * | 9/1956 | Tames | 383/16 |
| 3,434,589 | A * | 3/1969 | Valtri et al. | 206/218 |
| 4,212,377 | A | 7/1980 | Weinreb | |
| 4,428,484 | A | 1/1984 | Rattay et al. | |

(Continued)

FOREIGN PATENT DOCUMENTS

| | | |
|---|---|---|
| FR | 1380738 | 2/1990 |

(Continued)

OTHER PUBLICATIONS

Eileen Douglas Letter of May 25, 1996.

(Continued)

*Primary Examiner*—Robin A. Hylton
(74) *Attorney, Agent, or Firm*—Ryan Kromholz & Manion, S.C.

(57) ABSTRACT

A collapsible container including a plurality of adjacent side panels, each of the side panels having a flexible frame and a web having a perimeter secured to the frame. Each of the side panels has a bottom side, a top side and two lateral sides. Each of the lateral sides of each side panel is attached to the lateral side of an adjacent side panel. A flexible floor panel has a plurality of sides. Each of the floor panel sides is attached to at least one of the side panel bottom sides. At least one of the side panels has an opening through which items may be placed into and removed from the container. A mesh may be disposed so as to act as a cover, which together with a respective side panel, may serve as a pouch for holding various items therein. The container may have a partition panel pivotally secured therein. A mesh may be releasably secured to its respective side panel to allow the container to be used as a basket.

17 Claims, 3 Drawing Sheets

U.S. PATENT DOCUMENTS

| | | | | | |
|---|---|---|---|---|---|
| 4,632,138 | A | | 12/1986 | Irwin | |
| 4,752,008 | A | | 6/1988 | Pratt | |
| 4,812,054 | A | * | 3/1989 | Kirkendall | 383/110 |
| 4,842,032 | A | | 6/1989 | Mastronardo | |
| 4,858,561 | A | * | 8/1989 | Springer | 119/165 |
| 5,007,250 | A | * | 4/1991 | Musielak | 62/372 |
| 5,011,008 | A | * | 4/1991 | Baker | 206/242 |
| 5,301,705 | A | | 4/1994 | Zheng | |
| 5,467,794 | A | | 11/1995 | Zheng | |
| 5,484,078 | A | * | 1/1996 | Bronovicki | 220/531 |
| 5,560,385 | A | | 10/1996 | Zheng | |
| 5,620,069 | A | * | 4/1997 | Hurwitz | 190/107 |
| 5,664,596 | A | | 9/1997 | Zheng | |
| 5,800,067 | A | | 9/1998 | Easter | |
| 5,816,279 | A | | 10/1998 | Zheng | |
| 5,906,290 | A | | 5/1999 | Haberkorn | |
| 5,964,533 | A | | 10/1999 | Ziglar | |
| 5,971,188 | A | | 10/1999 | Kellogg et al. | |
| 6,006,772 | A | | 12/1999 | Zheng | |
| 6,059,912 | A | | 5/2000 | Kellogg et al. | |
| 6,089,394 | A | | 7/2000 | Ziglar | |
| 6,102,569 | A | * | 8/2000 | Wang | 383/104 |
| 6,220,998 | B1 | | 4/2001 | Kellogg et al. | |
| 6,269,826 | B1 | | 8/2001 | Zheng | |
| 6,390,111 | B1 | | 5/2002 | Zheng | |
| D461,638 | S | | 8/2002 | Kellogg et al. | |
| 6,585,414 | B1 | * | 7/2003 | Peska | 383/38 |
| 6,702,119 | B1 | * | 3/2004 | Sabounjian | 206/577 |
| 6,705,338 | B1 | * | 3/2004 | Zheng | 135/126 |

FOREIGN PATENT DOCUMENTS

| | | | |
|---|---|---|---|
| GB | 2097244 | A | * 11/1982 |

OTHER PUBLICATIONS

Eileen Douglas Letter of Aug. 26, 1996.

Patent Application re: prior art product sold in U.S. by Stephen A. Fausel and Paul S. Zigler: specification for Collapsible Furniture, Jun. 1985.

* cited by examiner

COLLAPSIBLE CONTAINERS

This application is a continuation-in-part of application Ser. No. 10/043,931 filed on Jan. 11, 2002 now U.S. Pat. No. 6,585,414, which claims priority under 35 U.S.C. 119(e) from provisional application Ser. No. 60/261,079 filed on Jan. 11, 2001.

BACKGROUND OF THE INVENTION

1. Field of the Invention

The present invention relates to containers. More particularly, it relates to containers for carrying objects which while being carried, can be separated into different groups or can be stored so that they remain in position within the container. Further, the present invention relates to containers of this type that may have mesh walls, which may be collapsible.

2. Prior Art

There exist collapsible containers having mesh walls. Generally, a frame made of a resilient, flexible material such as a steel wire is covered by a mesh. The container may have four walls and a bottom or floor formed in this manner. An appropriate opening is provided, generally at the top, for inserting and removing objects to be carried. When the objects are removed, the frame may be folded and twisted in an appropriate manner to reduce it to almost negligible size for purposes of storage.

Containers of this type may be used, for example, for carrying laundry. However, when laundry is carried, it is often desired to sort the items into those made of white fabrics and those made of colored fabrics. This is because the white fabric generally is treated more harshly during washing (for example bleach is used), while the fabrics having color are treated more gently to avoid the color bleeding from the fabrics or otherwise running, so as to ruin the color pattern or stain other items.

Further, when the laundry is complete, it is desirable to fold certain items, such as shirts (especially those that are made from a so called "permanent press" material), and carry them home in a folded condition, rather then simply tossing them back into the container, which would result in the items becoming wrinkled.

At the present time, there is no container that satisfies all of the requirements mentioned above.

SUMMARY OF THE INVENTION

It is an object of the present invention to provide a container that permits objects held therein to be separated into at least two different groups.

It is another object of the invention to provide a container that permits objects stored therein to be held securely in place within the container.

It is yet another object of the invention to provide a container of the above type that is collapsible, low in weight and of low cost.

It is still another object of the invention to provide a container that may be converted to a basket.

In accordance with the invention a container comprises a number of panels attached to one another to form the container. A swingable or pivoting partition or panel may be provided. The partition may be of approximately the same dimensions as a panel forming a wall of the container, thus permitting the container to be divided into compartments having relative sizes determined by the position of the partition. If the partition is positioned against one of the panel forming a wall of the container, then items placed in the container may be held securely in place within the container. Preferably, the container may be collapsed and expanded to a configuration in which it is not collapsed, at will. This may be due to the structure of the panels, which preferably are formed of a loop of a flexible and resilient material, and a panel wall, such as a mesh, supported by the frame. At least one panel may contain an additional cover, or mesh, within or outside the container, that defines a pouch or compartment for additional items. This panel may have an opening through which items may be inserted into or removed from the container.

Thus, the invention is directed to a collapsible container including a plurality of adjacent side panels, each of the side panels having a flexible frame and a web having a perimeter secured to the frame. Each of the side panels has a bottom side, a top side and two lateral sides. Each of the lateral sides of each side panel is attached to the lateral side of an adjacent side panel.

A flexible floor panel has a plurality of sides. Each of the floor panel sides is attached to at least one of the side panel bottom sides. A partition panel is pivotally secured to an interior portion of the container.

The container may further comprise a flexible top panel having sides, each of the top panel sides being attached to at least one of the side panel top sides, and an opening in at least one of the plurality of side panels, the top panel and the floor panel through which articles can be place in and removed from the container.

In general, the partition panel has an edge attached to the interior portion. More specifically the edge is affixed to an intersection of sides of adjacent side panels. The partition panel may have a size and shape substantially identical to one of the side panels or to the floor panel. In the later case the partition panel may have an edge secured along an intersection of a side panel and the floor panel. The partition panel may have a construction substantial identical to on of the side panels. The side panels are preferably substantially rectangular. There may be an even number of side panels; preferably four. Each web of the side panels has a perimeter, and an edging attached to the perimeter of the web and forming a pocket. The frame is positioned within the pocket. The web and the frame are formed of flexible materials.

The container may further comprise a storage pouch, the storage pouch being coupled to one of the side panels.

One of the side panels may define a boundary of the storage pouch. The storage pouch may be disposed within or exterior to the container.

The container may have at least one handle, secured to at least one of the side panels. Preferably one handle will be secured to two oppositely disposed side panels.

An elastic band for holding the container in a collapsed condition may be provided. Alternatively, the handles may serve this purpose.

In accordance with yet another aspect of the invention, a web of one of the side panels may be releasably attached, as for example by a zipper along three sides, so that an opening may be created through which articles may be placed in and removed from the container. When in this configuration, the container may serve as a basket, with an internally secured handle protruding from the opening.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
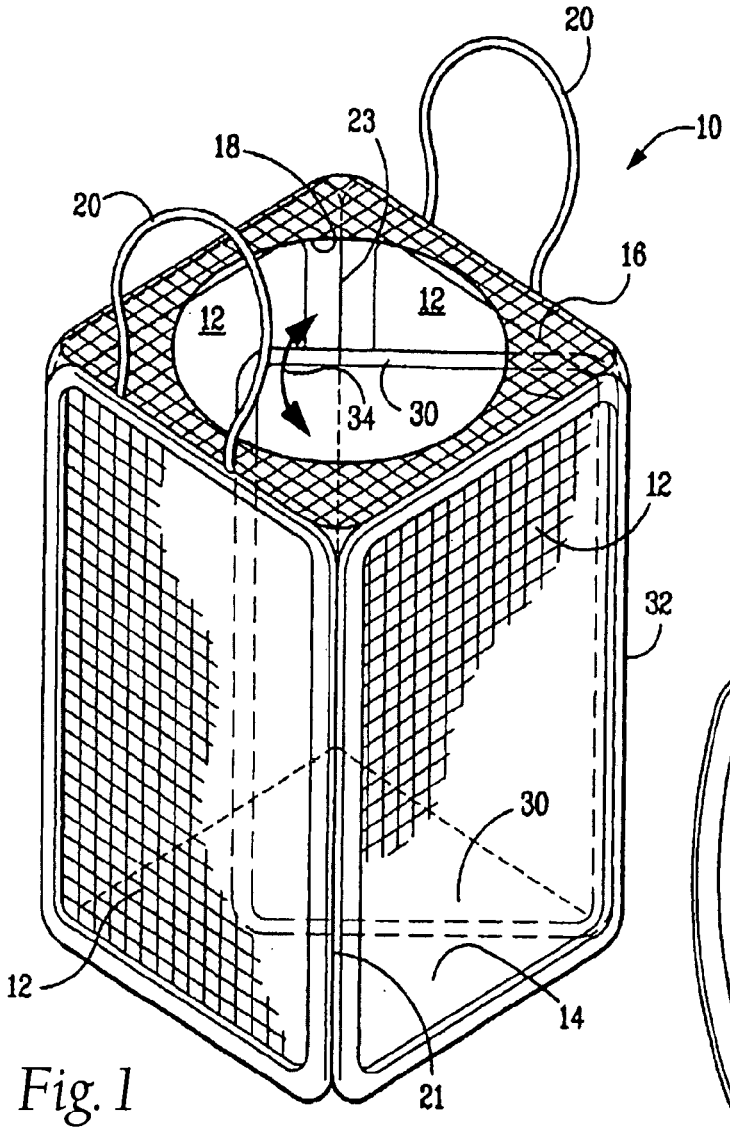
FIG. 1 is a perspective view of a container in accordance with a first embodiment of the invention.
Figure 2:
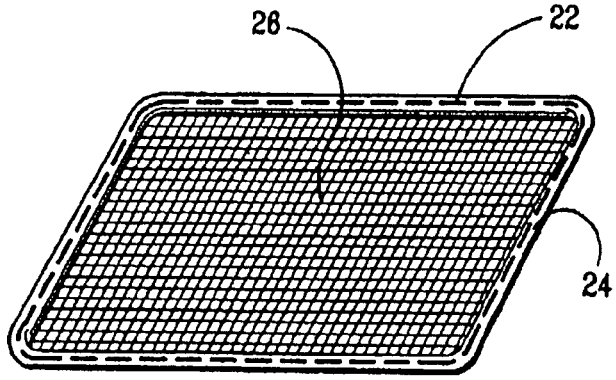
FIG. 2 is a perspective view of a panel of the container of FIG. 1.
Figure 4:
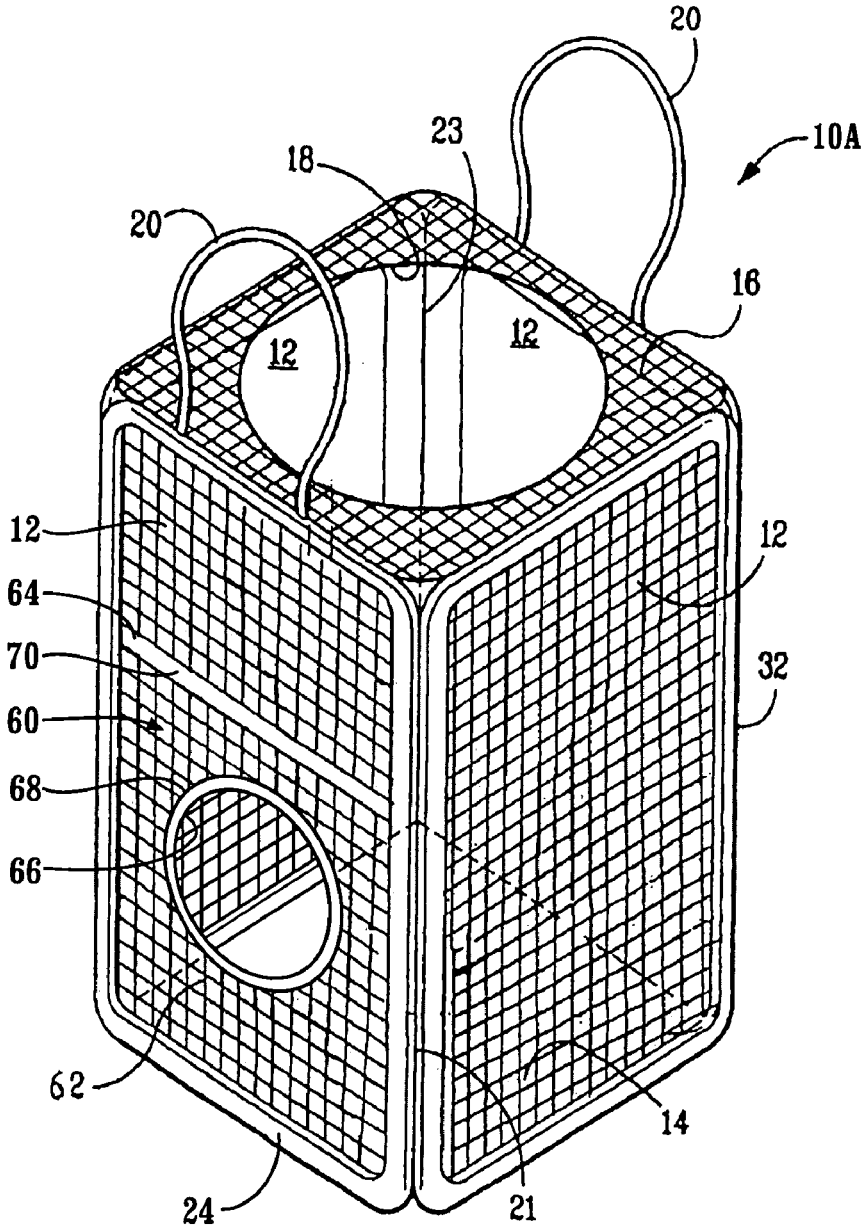
FIG. 4 is a perspective view of a container in accordance with a second embodiment of the invention.
Figure 5:
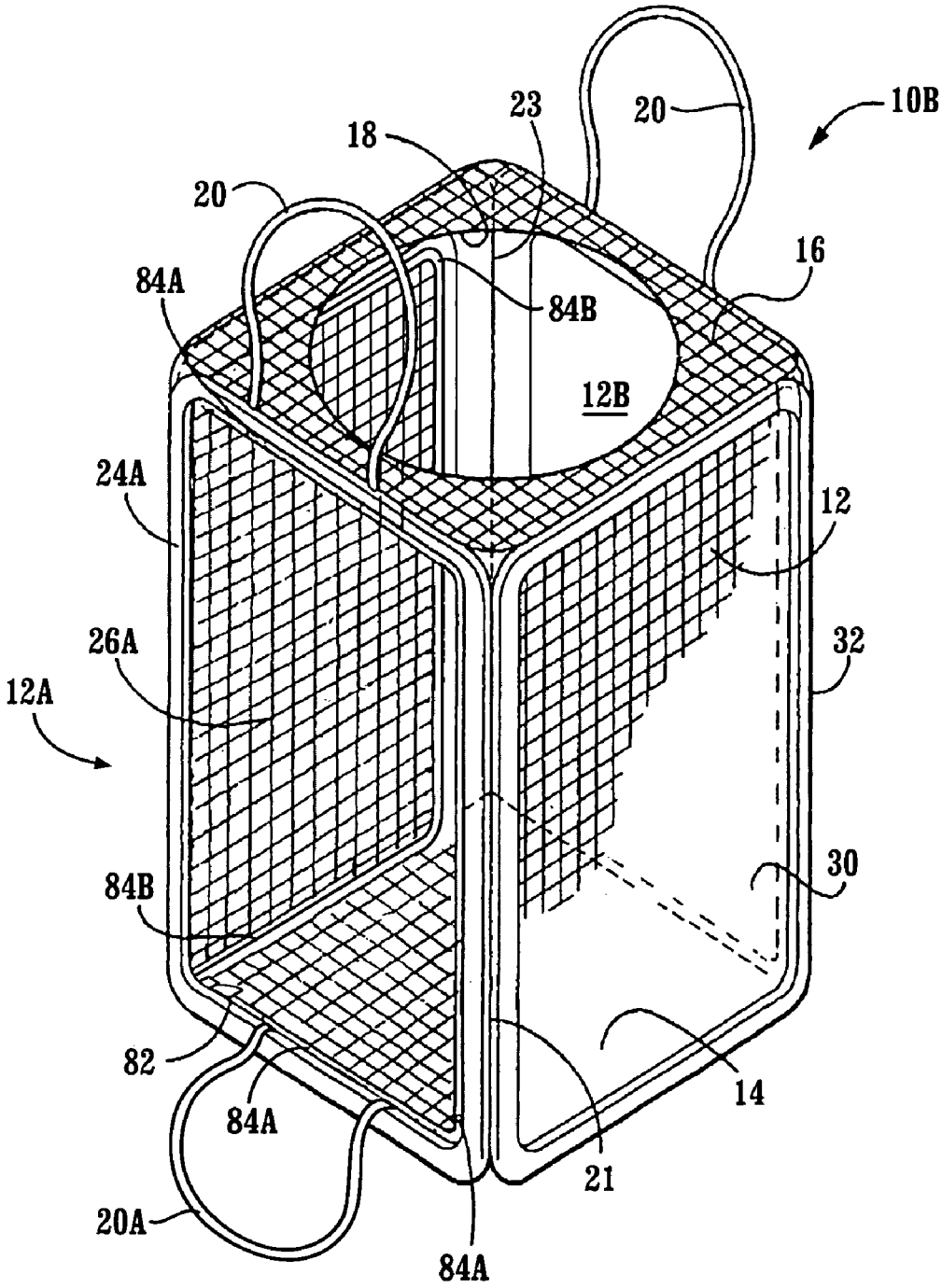
FIG. 5 is a perspective view of a container in accordance with a third embodiment of the invention.

Referring to FIG. 1 and FIG. 2, there is shown a perspective view of a container 10 incorporating features of the present invention. Although many of the features of the present invention will be described with reference to the embodiment shown in FIG. 1 and FIG. 2, it should be understood that the present invention may be embodied in many alternate forms of embodiments (as shown in FIG. 4 and FIG. 5). In addition, any suitable size, shape or type of elements or materials could be used. In the drawings, like reference numerals indicate like parts.

With reference to FIG. 1 and FIG. 2, container 10 includes four side panels 12 and a floor panel 14. A top panel 16 may have an opening 18 for placing objects such as items to be laundered into container 10 and for the removing items therefrom. It will be understood that openings may be provided at other places, such as in side panels 12 for the same purpose. It will also be understood that while top panel 16 has been represented as having a mesh construction, a continuous material, such as a polymer sheet may be used to from top panel 16. Handles 20 may be provided to allow container 10 to be easily carried.

Figure 3:
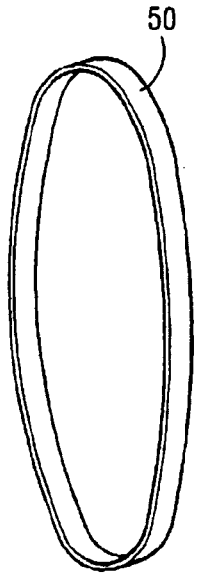
FIG. 3 is a perspective view of an elastic loop used to retain the container of FIG. 1 in a collapsed state.

Each panel 12, as well as panels 14 and 16, may be constructed of a frame 22 (FIG. 2) made of a flexible, resilient material which can be folded and twisted, but upon release returns to its generally rectangular shape, as shown in FIG. 1. The panels are joined together along their edges, by for example stitching, to form container 10, as shown in FIG. 1. Alternatively. a fabric like material may be provided with a series of pockets at appropriate places for receiving flexible wire frames that provide the generally rectangular shape of the container when it is in its open or un-collapsed configuration, as more fully described below. Container 10 may be collapsed by bring edges 21 and 23 toward one another until the structure is essentially flat, and then by twisting and folding the resulting structure to collapse it further. The resulting configuration may be held in its collapsed state by an elastic band 50, in the form of an endless loop (FIG. 3), until the user is ready to use it again. At that time the band 50 is removed, the container returns on its own to the shape of a rectangle, and edges 21 and 23 are separated to allow the container to regain the shape shown in FIG. 1. Alternatively, the handles may be formed of an elastic material and used to secure container 10 in a collapsed configuration.

Frame 22 is preferably surrounded by a continuous pocket 24, which completely encloses frame 22. A webbing 26 is attached about its periphery to pocket 22 and forms the wall of each panel 12. Webbing 26 may be formed of a nylon mesh material or any other material of sufficient strength to act as enclosure for the items to be placed in container 10, and sufficient resiliency to recover its shape after panels 12 are repeatedly folded, twisted, unfolded and allowed to return to their original generally rectangular shape. Any suitable fabric may also be used.

In accordance with the invention, a partition or separation panel 30, which may be of construction identical to that of one of panels 12, is swingably attached, such as for example by stitching, to the inside of container 10 along edge 32. Panel 30 has several functions. First, it acts as a separator, allowing, for example sorted laundry to be stored on opposite sides of panel 30. Since panel 30 swings as shown by arrow 34, the size of each compartment defined on each side of panel 34 may be varied, depending on its exact position. In fact such variation will occur automatically, depending on the volume of the items placed on each side of panel 30. Second, if no sorting is to take place, it is possible to swing panel 30 against one of two of the panels 12 so that it is out of the way, and there is effectively only one compartment defined in container 10. In addition, if container 10 is of sufficient size, container 10 may be placed on a surface such as a work table (not shown) so that one of the panels 12 against which panel 30 may eventually swing, is disposed in contact with the work table. Panel 30 is then positioned to be in contact with the other of panels 12 against which it may swing. In other words, panel 30 is positioned to be disposed in a vertical plane, perpendicular to the surface of the work table. Then, shirts or other laundry items may be neatly folded and placed inside container 10 in contact with the horizontally disposed panel 12 which is in contact with the work table. A neat pile may be made. Panel 30 is then caused to swing down over the top of this pile, thus trapping the laundry items in their neatly folded pile. At this point edges 21 and 23 are forced toward one another, collapsing container 10 into a rectangle on the work table. This rectangle may be folded along the line of edges 21 and 23, thus securing the laundry items in a secure manner so that they can be transported without being wrinkled.

It is possible to enhance the utility of container 10 by providing a second mesh (not shown) on one or more of the panels 12 that may be fastened, preferably at the periphery thereof, at the bottom and at two vertical edges. This additional mesh does not have to be coextensive with the panel, but may extend, for example, approximately two thirds of the way from the bottom to the top, thus forming a pocket. Preferably, this at least one mesh may be disposed on the outside of container 10, forming a pocket for additional items, such as additional laundry pieces, or laundry supplies. However, such additional mesh may also be placed inside container 10, thus forming an internal pocket for additional items. It may also be used to help render items immobile in container 10, including just washed or folded clothing.

Other embodiments of the invention are contemplated. For example, the partition panel may be similar in size to the floor panel. In this case in may have an edge secured along the intersection of a side panel and the floor panel. In this embodiment, the partition panel may swing or pivot from a position in contact with a side panel, and a position where it is in contact with the floor panel.

Referring to FIG. 4, for simplicity of illustration, an embodiment of the invention in the form of a container 10A not having panel 30 is illustrated, although it will be understood that the embodiment of FIG. 4 may have a panel 30. A pouch 60 is formed by an additional mesh 62 covering the outside of approximately the lower two thirds of one of panels 12. Mesh 62 is secured to container by stitching to pocket 24 of the panel 12, about the periphery of mesh 62, except at a top border 64 thereof. A circular opening 66 is formed in the mesh of panel 12. Opening 66 has a circular finishing border 68 sewn about its periphery. A linear finishing border 70 is sewn to the top of mesh 62.

In the embodiment of FIG. 4 items may be place in and/or removed from container 10A either from the top opening 18 or through opening 66. However, the presence of mesh 62, which is stretched to be somewhat tight (when container 10A is in its un-collapsed configuration, as shown in FIG. 4) and covers opening 66, does not permit items to be inadvertently removed from container 10A, such as by falling out. Removing or inserting an item through opening 66 requires a conscious effort, in that the hand must be inserted between panel 12 and mesh 62, and further into container 10A. While this is easily accomplished when desired, accidental removal of items is not likely to occur.

FIG. 5 illustrates an embodiment of the invention in the form of a container 10B that may serve as a collapsible laundry container or as a collapsible basket. While the construction is similar to that of the embodiment of FIG. 1 and FIG. 2, a zipper, operated by a zipper pull 82 has mating portions 84A and 84B that releasably connect three sides of mesh 26A to a pocket 24A of side panel 12A. Mesh 26A may be permanently connected to a fourth side of pocket 24A of side panel 12A. A handle 20A is connected to the side of panel 12A that is in turn connected to panel 14. The ends of the material (for example a cloth strip) forming handle 20A are preferably connected internally at the intersection of pocket 24A and panel 14 so that handle 20A may be stored within container 10B when zipper pull 82 is used to pulled the zipper closed, and web 26A assumes the position of the corresponding web in the embodiment of FIG. 1 and FIG. 2. In that position, panel 14 serves as a bottom panel, and container 10B may be used in the manner discussed above with respect to FIG. 1 and FIG. 2. However, if zipper pull 82 is moved to the open position, and container 10B is placed on its side (both as shown in FIG. 5), then container 10B may be carried by handle 20A (protruding from container 10B) and the top one of handles 20, thus serving as a basket. In this configuration, panel 14 serves as a side panel.

It will be understood that while not shown for purposes of simplified illustration, container 10B may be configured with a swinging partition panel 30, as shown in FIG. 1 and FIG. 2, and most easily envisioned by turning FIG. 1 on its side to be in the orientation of container 10B of FIG. 5. Such panel 30 may be used to perform all of the functions described above with respect to FIG. 1 and FIG. 2, but has one additional advantage when used in the embodiment of FIG. 5. Specifically, when placed in the position in which panel 12B is covered by a panel 30, panel 30 serves to reinforce panel 12B, when panel 12B is acting as the bottom panel and carrying the load of any items placed in container 10B. This adds to the carrying capacity and life of container 10B when used as a basket for various items.

While a zipper is preferred for releasably connecting mesh 26A to pocket 24A, it will be understood that other releasable connections may be made. For example a fabric fastener, commonly sold under the name Velco®, may be used. Further, although web 26A is preferably permanently attached along one side of pocket 24A, in principle, in the configuration shown in FIG. 5, it may be completely detached. In that case care must be taken that it is not lost, if container 10B is to be used again in the manner illustrated in FIG. 1 and FIG. 2. In all embodiments, the floor panel 14, the top panel 16 and one or more of the side panels 12 may be formed of a continuous flexible material, rather than a mesh. This may permit a decorative pattern to be placed thereon.

It should be understood that the foregoing description is only illustrative of the invention. Various alternatives and modifications can be devised by those skilled in the art without departing from the invention. Accordingly, the present invention is intended to embrace all such alternatives, modifications and variances which may fall within the scope of the claims.

What is claimed is:

1. A collapsible container, comprising:

a plurality of adjacent side panels, each of said side panels having a flexible frame and a web, each web of said side panels having a perimeter, an edging attached to the perimeter of the web and forming a pocket, the frame being positioned within the pocket, each of said side panels having a bottom side, a top side and two lateral sides, each of said lateral sides of each side panel being attached to the lateral side of an adjacent side panel;

a web of one of said side panels being releasably secured to a plurality of sides of its respective frame at said edging, so that said web may be positioned to allow objects to be placed in and removed from said container through an opening formed when said web is released from said frame;

a flexible floor panel having a plurality of sides, each of said floor panel sides being attached to at least one of said side panel bottom sides; and a flexible top panel having sides, each of said top panel sides being attached to at least one of said side panel top sides, and an opening in said top panel through which articles can be placed in and removed from said container.

2. The collapsible container of claim 1, comprising a zipper for releasably connecting said web to said frame at said edging.

3. The collapsible container of claim 2, wherein said zipper extends along three sides of said frame.

4. A collapsible container, comprising:

a plurality of adjacent side panels, each of said side panels having a flexible frame and a web, each web of said side panels having a perimeter, an edging attached to the perimeter of the web and forming a pocket, the frame being positioned within the pocket, each of said side panels having a bottom side, a top side and two lateral sides, each of said lateral sides of each side panel being attached to the lateral side of an adjacent side panel;

a web of one of said side panels being releasably secured to a plurality of sides of its respective frame at said edging, so that said web may be positioned to allow objects to be placed in and removed from said container through an opening formed when said web is released from said frame;

a flexible floor panel having a plurality of sides, each of said floor panel sides being attached to at least one of said side panel bottom sides; and a partition panel pivotally secured to an interior portion of said container.

5. The container of claim 4, wherein said partition panel has an edge attached to said interior portion.

6. The container of claim 4, wherein said partition panel has an edge affixed to an intersection of sides of adjacent side panels.

7. The container of claim 4, wherein said partition panel has a size and shape substantially identical to one of said side panels.

8. The container of claim 4, wherein said partition panel has a size and shape substantially identical to said floor panel.

9. The container of claim 8, wherein said partition panel has an edge secured along an intersection of a side panel and the floor panel.

10. The container of claim 4, wherein said partition panel has a construction substantially identical to one of said side panels.

11. The container of claim 4, further comprising at least one handle secured to at least one of said side panels.

12. The container of claim 1, in combination with an elastic band for holding said container in a collapsed condition.

13. The container of claim 1, wherein said side panels are substantially rectangular.

14. The container of claim 1, where in said plurality of side panels consists of four.

15. The container of claim 1, wherein said plurality of side panels is an even number.

16. The collapsible container of claim 1, wherein said web of each of said side panels is a flexible material.

17. The collapsible container of claim 1, wherein said frame of each of said side panels is flexible.

* * * * *